US005481279A

United States Patent [19]

Honda et al.

[11] Patent Number: 5,481,279

[45] Date of Patent: Jan. 2, 1996

[54] METHOD AND SYSTEM FOR DISPLAYING SERIAL IMAGES

[75] Inventors: Michitaka Honda; Kenichi Komatsu, both of Tochigi, Japan

[73] Assignee: Kabushiki Kaisha Toshiba, Kawasaki, Japan

[21] Appl. No.: 73,977

[22] Filed: Jun. 8, 1993

Related U.S. Application Data

[63] Continuation of Ser. No. 539,317, Jun. 14, 1990, abandoned, which is a continuation of Ser. No. 183,634, Apr. 19, 1988, abandoned.

[30] Foreign Application Priority Data

Apr. 27, 1987 [JP] Japan ..... 62-103901
Sep. 2, 1987 [JP] Japan ..... 62-219914

[51] Int. Cl.[6] ..... G09G 1/28

[52] U.S. Cl. ..... 345/200; 348/578; 345/201

[58] Field of Search ..... 345/185, 189, 345/190, 192, 193, 200, 122, 201; 358/11, 140; 364/413.14, 413.22; 378/98, 99, 100; 382/6; 128/661.04; 348/578

[56] References Cited

U.S. PATENT DOCUMENTS 4,620,098 10/1986 Fujiwara .
4,652,921 3/1987 Rae-Smith ..... 378/99
4,658,412 4/1987 Finkler et al. ..... 378/100
4,668,974 5/1987 Kita et al. ..... 358/11
4,688,175 8/1987 Kaneko et al. ..... 378/99
4,689,670 8/1987 Okazaki ..... 378/99
4,709,332 11/1987 Morrison et al. ..... 378/99
4,709,385 11/1987 Pfeiler et al. ..... 378/99
4,729,379 3/1988 Ohe ..... 378/99
4,746,981 5/1988 Nadan et al. ..... 340/731
4,802,093 1/1989 Ema ..... 378/99
4,930,144 5/1990 Plut et al. ..... 358/11

FOREIGN PATENT DOCUMENTS

182099A1 10/1985 Germany .
218094A1 9/1986 Germany .

*Primary Examiner*—Richard Hjerpe
*Assistant Examiner*—M. Fatahiyar
*Attorney, Agent, or Firm*—Finnegan, Henderson, Farabow, Garrett & Dunner

[57] ABSTRACT

An X-ray imaging system wherein serial frame images are stored in the image memories. Memory selection of image memories is controlled by a microcomputer in accordance with the number of frame images and an interval between R-waves of an electrocardiogram signal of a subject detected by phase detector. By such a system, each serial frame the image read out from image memories in accordance with an address signal supplied by address generator can be displayed by a TV monitor in the same period.

3 Claims, 6 Drawing Sheets

METHOD AND SYSTEM FOR DISPLAYING SERIAL IMAGES

This application is a continuation of application Ser. No. 07/539,317, filed Jun. 14, 1990, now abandoned, which is a continuation of application Ser. No. 07/183,634, filed Apr. 19, 1988, now abandoned.

BACKGROUND OF THE INVENTION

1. Field of the Invention

This invention relates to a method and system for displaying images obtained serially for a predetermined period of time.

2. Description of the Related Art

Conventional X-ray photographing systems are arranged to obtain X-ray frame images and display on a display device moving or dynamic images of a heart, for instance, whose form periodically varies. In displaying images at a frame rate n (frames/second) used at the time of photographing, the display device can control the display rate only in units of n/i (frames/second; i=1, 2, 3, . . . ). In other words, the display device simply clears unwanted frames to control the display rate. This enables an observer to observe images at a desired rate. For example, when comparing between two subjects under examination in movement of their hearts, display periods of two images for the subjects will differ delicately. When the display device started to display the two images in synchronism with an electrocardiogram signal, the two images would become out of harmony with each other in the movement of the hearts, leading to difficulty in the comparison of movement.

Therefore, a device is desired which is capable of displaying images serially obtained during a predetermined time at a predetermined rate.

SUMMARY OF THE INVENTION

It is an object of this invention to provide a method and system for displaying images serially obtained for a predetermined period of time at a desired rate.

According to one aspect of the present invention, there is provided a method for displaying serial frame images of a subject, the method comprising the steps of: storing a plurality of serial frame images of the subject; detecting a period by parameters representing a variation of the subject; supplying periodic address signals for reading out the plurality of serial frame images; controlling a timing of readout selection of the plurality of serial frame images stored in accordance with the period detected, thereby reading out the plurality of serial frame images by periodic address signals supplied; and displaying the plurality of serial frame images of the subject read out in accordance with the timing of readout selection of the plurality of serial frame images controlled.

According to another aspect of the present invention, there is provided a system for displaying serial frame images of a subject, the system comprising: storing means for storing a plurality of serial frame images of the subject; detecting means for detecting a period by parameters representing a variation of the subject; supplying means for supplying periodic address signals for reading out the plurality of serial frame images stored in the storing means; controlling means for controlling a timing of readout selection of the plurality of serial frame images for the storing means in accordance with the period detected by the detecting means, thereby reading out the plurality of serial frame images stored in the storing means by periodic address signals supplied by the supplying means; and displaying means for displaying the plurality of serial frame images of the subject readout from the storing means in accordance with the timing of readout selection of the plurality of frame images controlled by the controlling means.

According to another aspect of the present invention, there is provided a system for displaying serial frame images of a subject, the system comprising: storing means for storing a plurality of serial frame images of the subject; setting means for setting data representing a timing of readout selection of the plurality of serial frame images stored in the storing means; supplying means for supplying periodic address signals for reading out the serial frame image stored in the storing means; controlling means for controlling the timing of readout selection of the plurality of serial frame images from the storing means in accordance with the data set by the setting means, thereby reading out the plurality of serial frame images by the periodic address signals supplied by the supplying means; and displaying means for displaying the plurality of serial frame images of the subject read out from the storing means in accordance with the timing of readout selection of the plurality of serial frame images controlled by the controlling means.

DETAILED DESCRIPTION OF THE PREFERRED EMBODIMENT

An embodiment of the present invention will be described with reference to the accompanying drawings.

Figure 1:
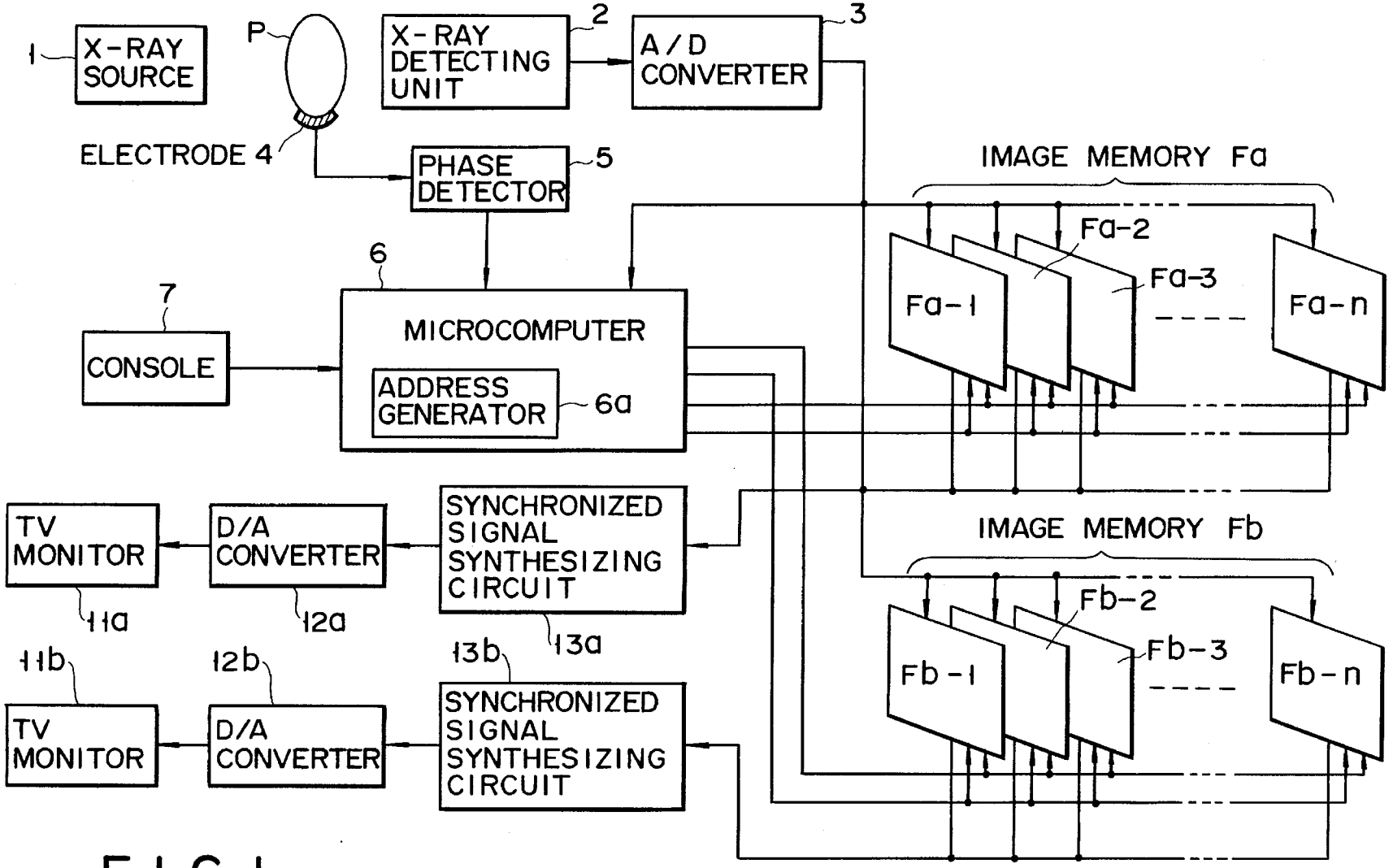
FIG. 1 is a block diagram of an X-ray photographing system provided with an image display device according to an embodiment.

Referring now to FIG. 1 X-ray source 1 generates X-rays. X-rays passed through a subject P under examination are detected by X-ray detecting unit 2 and are converted into electric signals. The electric signals (analog signals) are applied to A/D converter 3 for converting the analog signals to digital signals. The digital signals are stored as image data in image memories Fa and Fb having frame memories Fa-1–Fa-n, and Fb-1–Fb-n, respectively.

An electrocardiograph (not shown) is provided which has electrode 4 attached to subject P to acquire electrocardiogram signals applied to phase detector 5. Phase detector 5 detects synchronized signals, for example, R-waves corresponding to motions of the heart of subject P and outputs the synchronized signals to microcomputer 6.

Microcomputer 6 includes address generator 6*a* which applies readout address signals to each of the frame memories in image memories Fa and Fb. Microcomputer 6 acquires image data on a region of interest of each frame image. The region of interest is set by a signal provided from console 7.

Figure 2:
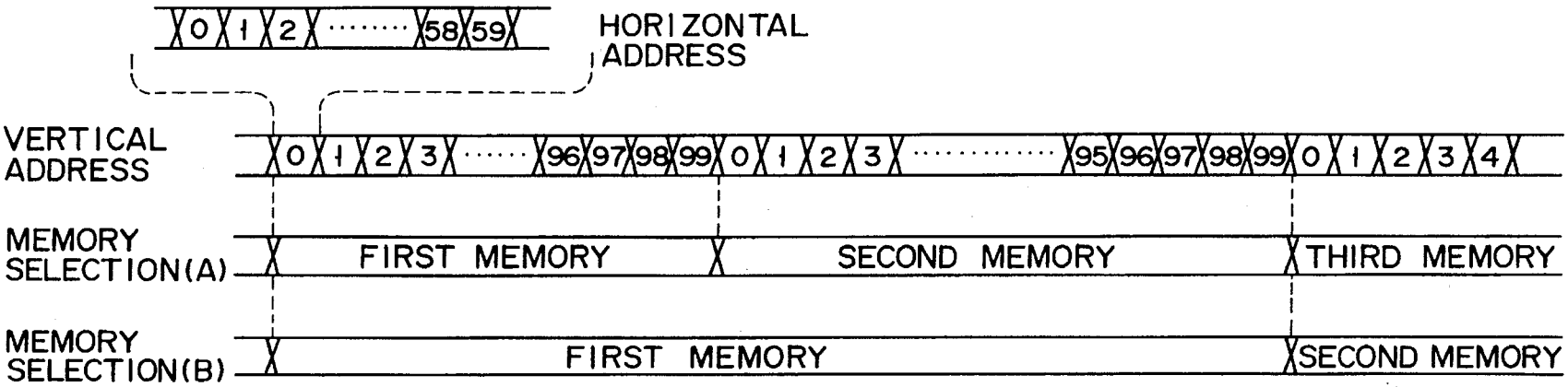
FIG. 2 shows timing in operation of a conventional image display device.
Figure 3:
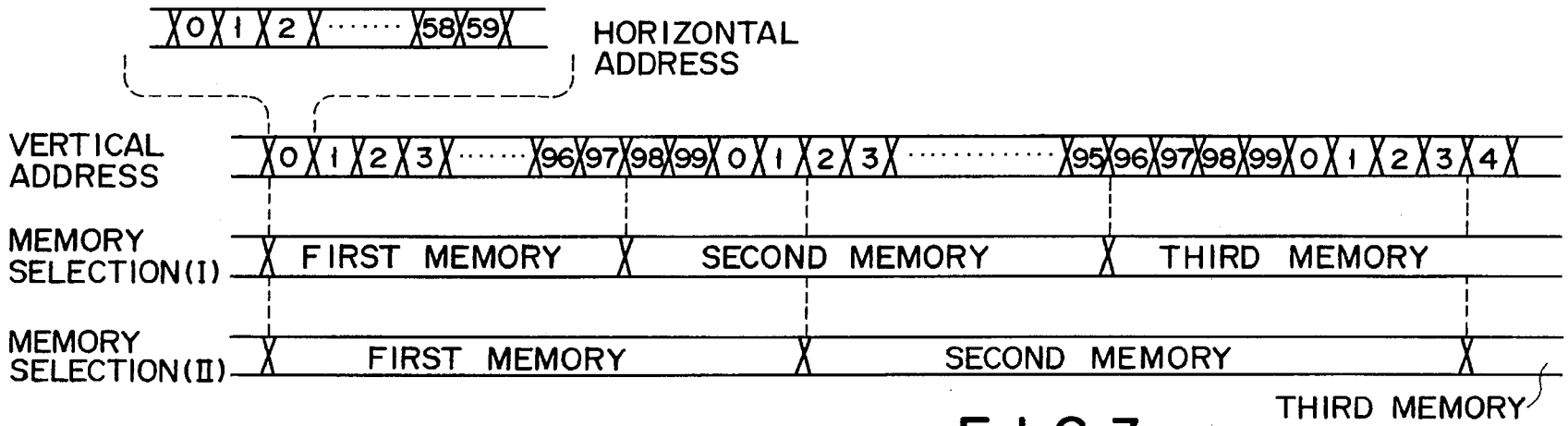
FIG. 3 shows timing in operation of the image display device in the present embodiment.

As an example, a digital image comprised of 60 horizontal pixels and 100 vertical pixels (60×100 matrix) is stored in each of the frame memories. Address generator 6*a* included in microcomputer 6 periodically generates, as shown in FIGS. 2 and 3, vertical addresses 0–99, and horizontal addresses 0–59 for each of the vertical address, which are applied to each frame memory as address signals.

Figure 4A:
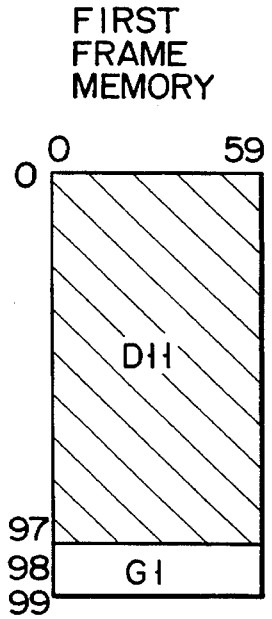
FIGS. 4A to 4C and FIGS. 5A to 5C are diagrams for explaining access to an image memory.
Figure 4B:
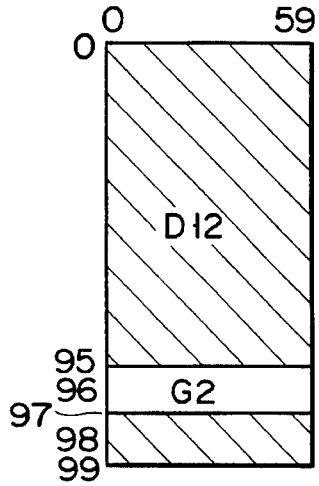
Figure 4C:
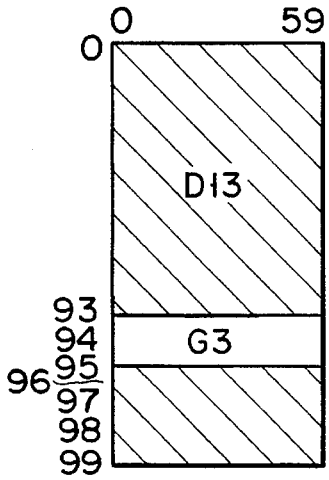

As shown in FIGS. 4A–4C, microcomputer 6 operates to select vertical addresses 0–97 for the first frame memory (FIG. 4A), vertical addresses 98, 99, 0–95 for the second frame memory (FIG. 4B), and vertical addresses 96–99, 0–93 for the third frame memory (FIG. 4C).

By the address designation and frame memory selection, 60×98 pixel image data corresponding to portions indicated by oblique lines shown in FIG. 4A–4C are sequentially read out. The image data read from image memories Fa and Fb is applied to synchronized signal synthesizing circuits 13*a* and 13*b* so that TV vertical and horizontal synchronized signals are added thereto. The output signals of synchronized signal synthesizing circuits 13*a* and 13*b* are converted to analog TV signals by D/A converters 12*a* and 12*b* and then displayed on TV monitors 11*a* and 11*b*.

Next, the operation of the image display device in the present system will be described.

Image data D11, D12 and D13 corresponding to 60×98 pixels in FIGS. 4A–4*c* are sequentially read out in readout time of T×(98/100) seconds because two horizontal line components G1, G2 and G3 are not read out. T is a period of time required to write 60×100 pixel image data from a frame memory. In the above case it will be evident that the image data readout time can be reduced. Therefore, the adjustment of display rate can be performed delicately as compared with the conventional display-rate adjusting technique based on the removal of unwanted frames.

In more detail, as shown in FIG. 2, the conventional frame memory selection (A) is to perform the selection of frame memory after all the image data of 60×100 pixels have been read out. Further, the conventional frame memory selection (B) is to perform the selection of frame memory in a cycle which is an integral multiple of that of the frame memory selection (A). With such a memory selection, although the display rate can be controlled, delicate control of a predetermined display rate is impossible.

With the embodiment, on the other hand, the next frame memory is selected before the readout address for the first frame memory reaches the vertical address 99 (memory selection (I)). For example, when predetermined display rate data is output from console 7 to microcomputer 6, microcomputer 6 outputs readout signals sequentially to the first memory in accordance with the display rate data output from console 7. When an image stored in each frame memory is photographed in 30 frames per second, the image can be displayed at a rate above 30 frames per second. In the above case, the images D11, D12, D13, etc. stored in the respective frame memories are displayed on TV monitor at a rate of 30×100/98=30.6 frames per second. Namely, the image can be displayed faster than in the case of photographing.

Figure 5A:
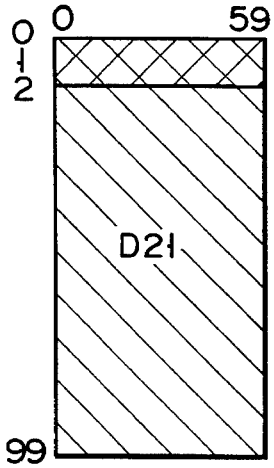
Figure 5B:
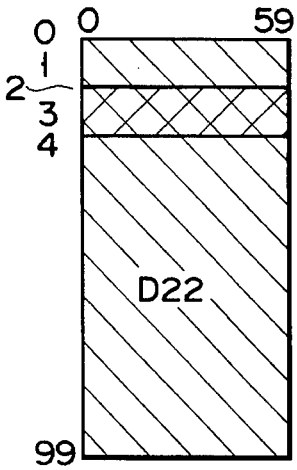
Figure 5C:
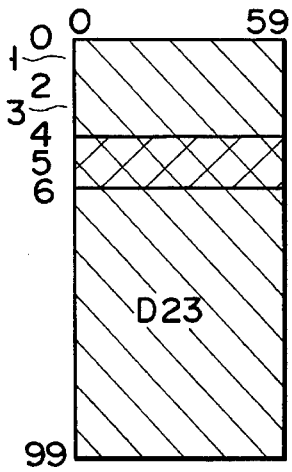

As described above address generator 6*a* included in microcomputer 6 periodically generates vertical addresses 0–99, and horizontal addresses 0–59 for each of the vertical addresses, and applies them to each of the frame memories as readout address signals as shown in FIG. 3. In this case, however, the memory selection by microcomputer 6 differs from the above case. That is, as shown in FIGS. 5A–5C, microcomputer 6 selects the first frame memory for vertical addresses 0–99, 0, and 1, the second frame memory for vertical addresses 2–99, and 0–3, and the third frame memory for vertical addresses 4–99, and 0–5 (memory selection (II)).

The image data for 60×102 pixels indicated by oblique lines which are sequentially read out by the above described address designation and the memory selection are supplied with the horizontal and vertical synchronized signals in synchronized signal synthesizing circuits 13*a* and 13*b*, and then converted to analog signals by D/A converters 12*a* and 12*b* for subsequent display on TV monitors 11*a* and 11*b*.

According to the above processes, the images D21, D22 and D23 of 60×102 pixels are displayed on TV monitors 11*a* and 11*b* in a readout time T' where T='T×(102×100) seconds by reading two horizontal lines two times in the frame memory of 60×100 pixels. T is, as described above, a period of time required to read out 60×100 pixel data from a frame memory. It will be evident that the image can be displayed at a rate later than the rate in the case of photographing because the readout time increases. In this way the display rate can be adjusted delicately as opposed to the conventional adjustment based on increasing the number of frames. With the present embodiment there is a possibility of occurrence of noises on the displayed image at the instant of switching between the image memories for readout. The generation of noises will be prevented by switching between the image memories during a blanking period of horizontal synchronized signals.

As described above, by controlling the selection of frame memories the images stored in the respective frame memories can be displayed serially at a predetermined rate.

In a network system used in a hospital, for example, to examine the movement of the heart of a patient or the hearts of patients, sometimes two types of images acquired between one heartbeat are simultaneously displayed for comparison. Under the present state of diagnosis, a patient's heart is examined by invasive insertion of a catheter into a pacemaker. In the present embodiment, even if the two types of serial images differ in their sampling period they can be controlled to obtain the same display rate. In the display of plural, e.g. two types, of serial images differing in the sampling period the operation of the present system will be described hereinafter.

Figure 6:
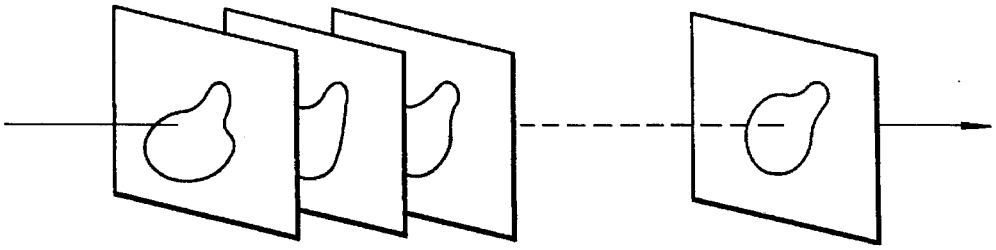
FIG. 6 is a diagram of frame memories stored serial images of a heart.
Figure 7:
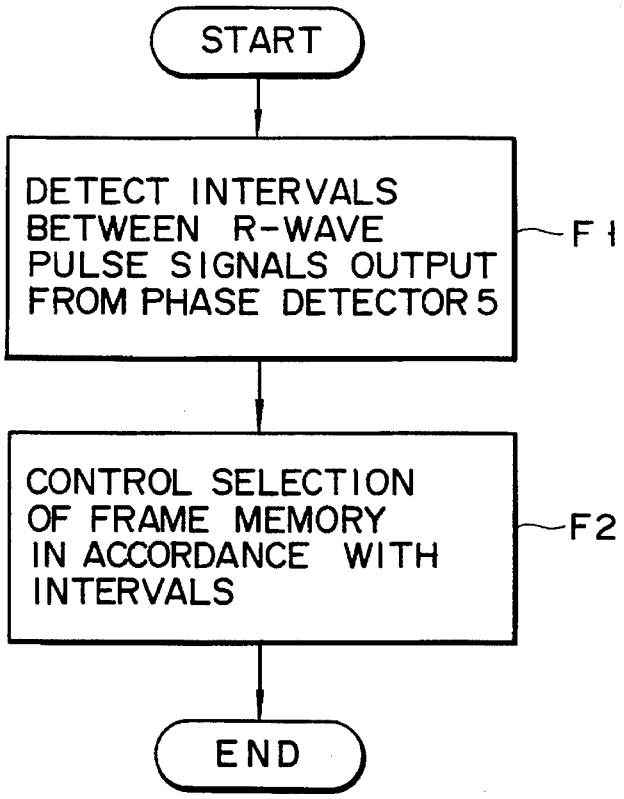
FIG. 7 is an operation flowchart of a microcomputer of controlling a display rate in accordance with electrocardiogram waveform.

In the present system the serial images of a heart shown in FIG. 6 are acquired for each of frames. When many types of serial images of the heart differ delicately in the sampling period, microcomputer 6 controls image display speed in accordance with a flowchart shown in FIG. 7.

Figure 8:
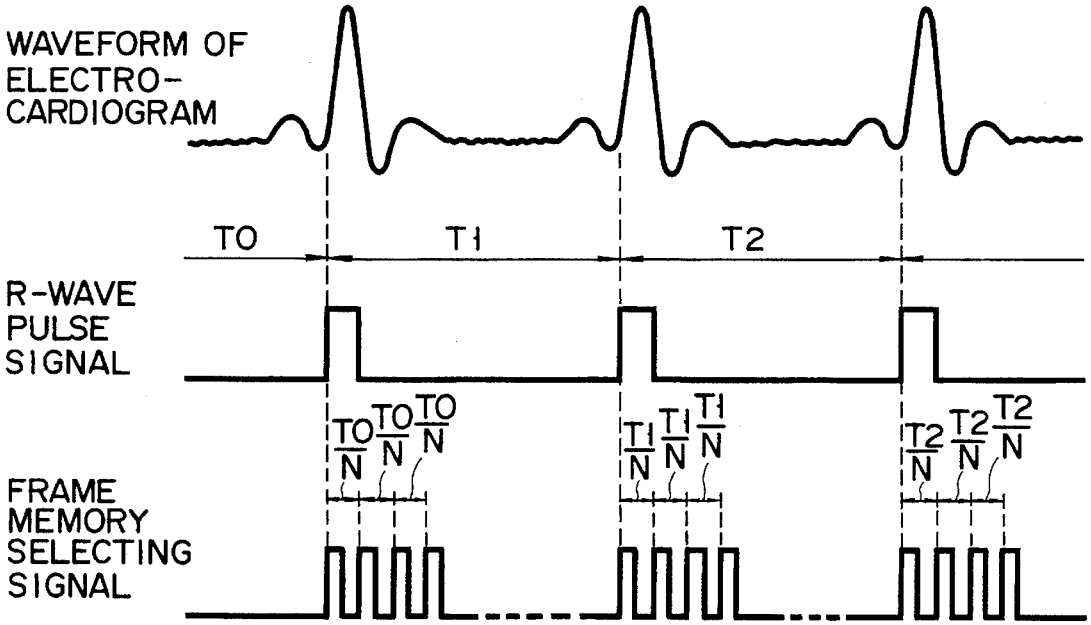
FIG. 8 is a timing chart for explaining the selection of a frame memory the electrocardiogram waveforms.

As shown in FIG. 8, R-wave pulse signals are input from phase detector 5 to microcomputer 6 by electrocardiogram waveforms detected by electrode 4. In step F1 of FIG. 7, the intervals, e.g., T0, T1, T2 between the R-wave pulse signals are detected. In step F2 frame memory selecting signals are applied to the image memories in accordance with the intervals detected by step F1. When N frames of image are stored in the image memory, the frame memory selecting signals are applied at intervals T/N (T0/N, T1/N, T2/N)

obtained by equally dividing the interval of R wave pulse signals by N.

Figure 9A:
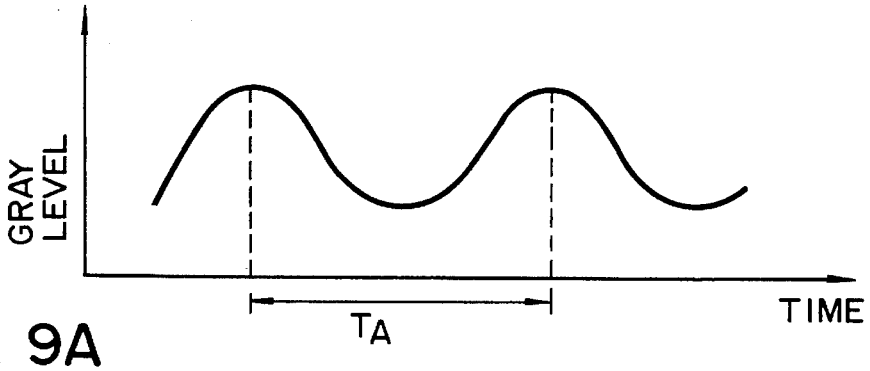
FIGS. 9A and 9B show the variation in the gray level of a region of interest within serial images.
Figure 9B:
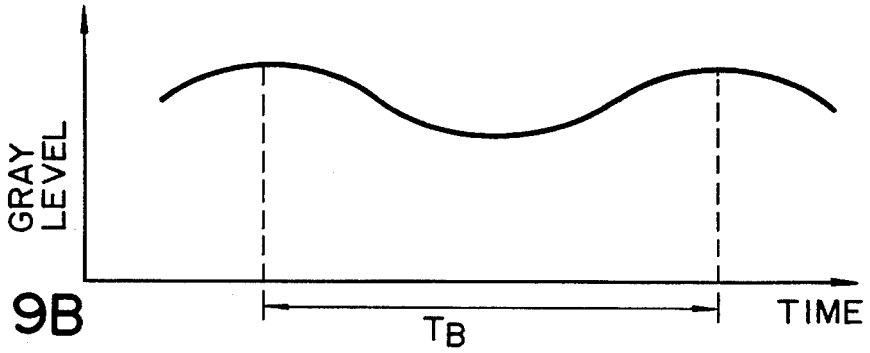
Figure 10:
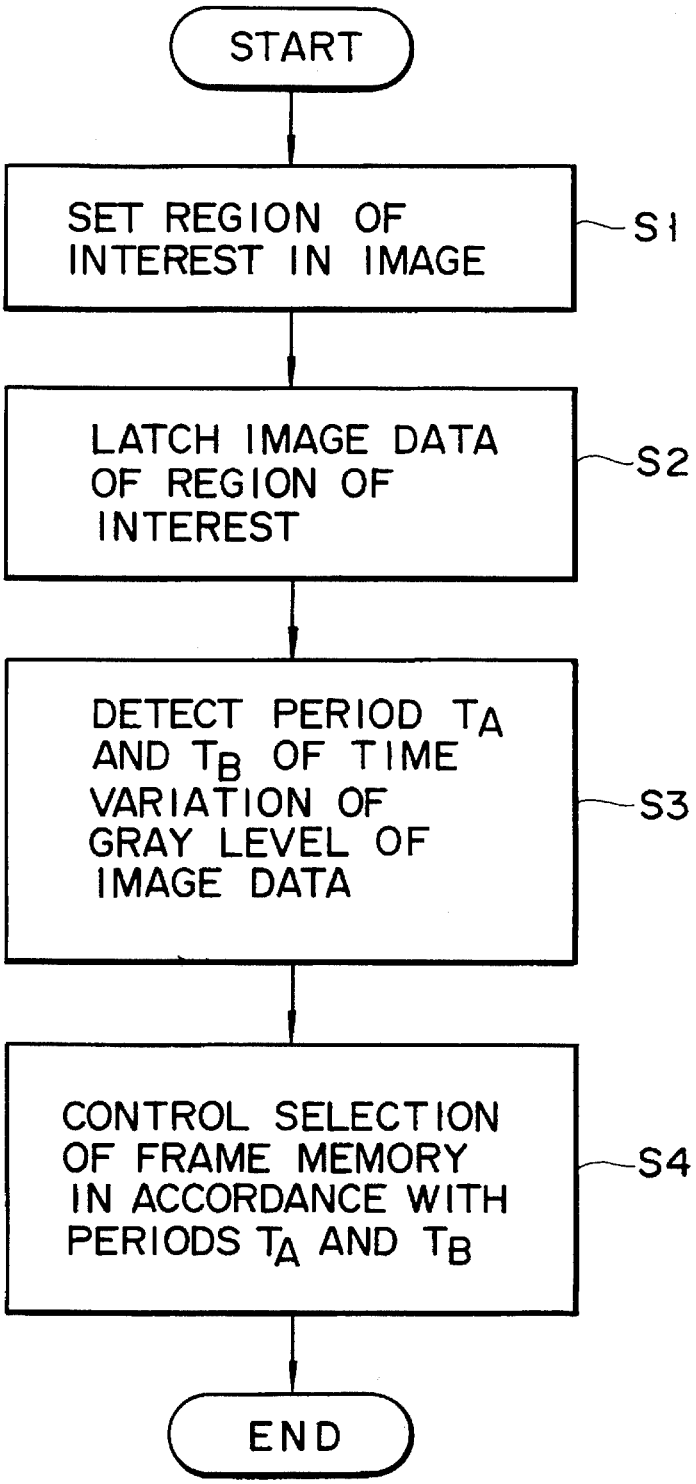
FIG. 10 is an operation flowchart of the microcomputer for controlling the display rate in accordance with time variation in the gray level of serial images.

Further, when the variation of gray level differs in the regions of interest in the two images as shown in FIGS. 9A and 9B, microcomputer 6 controls the image display speed in accordance with a flowchart of FIG. 10.

In step S1, the region of interest is set on the image by a signal output from console 7. In step S2, in each of the frame images output from A/D converter 3, only the image data on the region of interest set in step S1 is latched. In step S3, the periods $T_A$ and $T_B$ of the variation of gray level of the image data latched by step 22 are detected. In step S4, the select timing for each frame memory is controlled in accordance with the periods $T_A$ and $T_B$.

By the operations as described above, the display periods for two types of serial images can be agreed with each other.

Although the preferred embodiment of this invention has been disclosed and described, it is apparent that other embodiments and modification are possible.

What is claimed is:

1. A system for displaying sequentially a plurality of images, each image including N pixels, at a variable speed, comprising:

a plurality of frame memories for storing a plurality of serial frame images of the subject;

address signal generating means for generating readout vertical address signals and readout horizontal address signals;

data setting means for setting data corresponding to a rate of readout of the plurality of serial frame images stored in the frame memories, capable of selectively either increasing or decreasing the rate of the readout of the serial frame images;

supply means for supplying periodic vertical address signals and horizontal address signals for reading out the serial frame images stored in the frame memories;

mode setting means for selectively setting an increase mode and a decrease mode;

first image synthesizing means for, when the increase mode is set by the mode setting means, reading out an $N_1$ number of pixels of a first frame memory of the plurality of frame memories ($N_1<N$) and an $N_2$ number of pixels of a second frame memory of the plurality of frame memories ($N_1<N$, $N_1>N_2$), and synthesizing the readout pixels ($N_1$, $N_2$) to produce an image to be displayed by use of the data setting means and the supply means;

second image synthesizing means for, when the decrease mode is set by the mode setting means, reading out an N number of pixels and an $N_3$ number of pixels from said first frame memory, and synthesizing the readout pixels (N, $N_3$) to produce images to be displayed; and display means for continuously selectively displaying the images to be displayed which are produced by the first and second image synthesizing means, wherein said first frame memory and said second frame memory are adjacent to each other.

2. A display system adapted to continuously display a moving subject, comprising:

a plurality of frame memories for storing a plurality of serial frame images of the subject;

address signal generating means for generating readout vertical address signals and readout horizontal address signals;

data setting means for setting data corresponding to a rate of a readout of the plurality of serial frame images stored in the frame memories, capable of selectively either increasing or decreasing the rate of the readout of the serial frame images;

supply means for supplying periodic vertical address signals and horizontal address signals for reading out the serial frame images stored in the frame memories;

control means for controlling the timing of readout selection of the plurality of serial frame images from the frame memories in accordance with the data set by the data setting means, thereby reading out the plurality of serial frame images by the periodic vertical address signals and horizontal address signals supplied by the supply means;

first image producing means for producing a subject image which is provided by reading out an image preceding a frame image to be displayed and an image following the frame image to be displayed, when the data setting means increases the rate of readout of the frames;

second image producing means for producing a subject image which is provided by repeatedly reading out the frame image to be displayed, when the data setting means decreases the rate of readout of the frame; and display means for continuously displaying the subject images produced by the first and second image producing means.

3. A system for displaying sequentially a plurality of images, each image including N pixels, at a variable speed, comprising:

a plurality of frame memories for storing a plurality of serial frame images;

mode setting means for selectively setting an increase mode and a decrease mode;

first image synthesizing means for, when the increase mode is set by the mode setting means, reading out an $N_1$ number of pixels of a first frame memory of the plurality of frame memories ($N_1<N$) and an $N_2$ number of pixels of a second frame memory of the plurality of frame memories ($N_1<N$, $N>N_2$), and synthesizing the readout pixels ($N_1$, $N_2$) to produce an image to be displayed;

second image synthesizing means for, when the decrease mode is set by the mode setting means, reading out an N number of pixels and an $N_3$ number of pixels from said first frame memory two times, and synthesizing the readout pixels ($N_2$, $N_3$) to produce an image to be displayed; and display means for continuously displaying the images to be displayed which are produced by the first and second image synthesizing means, wherein said first frame memory and said second frame memory are adjacent to each other.

* * * * *

UNITED STATES PATENT AND TRADEMARK OFFICE

CERTIFICATE OF CORRECTION

PATENT NO. : 5,481,279

DATED : January 02, 1996

INVENTOR(S) : Michitaka HONDA et al

It is certified that error appears in the above-indentified patent and that said Letters Patent is hereby corrected as shown below:

Abstract, item [57], line 3, before "image"
(second occurrence) insert --the--;

Abstract, line 7, after "frame"
delete "the";

Abstract, line 8, before "image"
(second occurrence) insert --the--.

Signed and Sealed this

Third Day of December, 1996

Bruce Lehman

*Attest:*

BRUCE LEHMAN

*Attesting Officer*

*Commissioner of Patents and Trademarks*